United States Patent [19]

Beck

[11] Patent Number: 4,489,786

[45] Date of Patent: Dec. 25, 1984

[54] LOW PRESSURE RESPONSIVE DOWNHOLE TOOL WITH DIFFERENTIAL PRESSURE HOLDING MEANS

[75] Inventor: Harold K. Beck, Duncan, Okla.

[73] Assignee: Halliburton Company, Duncan, Okla.

[21] Appl. No.: 533,701

[22] Filed: Sep. 19, 1983

[51] Int. Cl.[3] ..... E21B 34/10

[52] U.S. Cl. ..... 166/374; 166/321; 166/332

[58] Field of Search ..... 166/374, 319, 321, 324, 166/325, 386, 387, 264, 332, 334

[56] References Cited

U.S. PATENT DOCUMENTS

| | | | |
|---|---|---|---|
| Re. 29,562 | 3/1978 | Wray et al. | 166/336 |
| 2,740,479 | 4/1956 | Schwegman | 166/145 |
| 3,358,755 | 12/1967 | Chisholm | 166/264 |
| 3,431,985 | 3/1969 | Bowen | 173/119 |
| 3,646,995 | 3/1972 | Manes et al. | 166/336 |
| 3,664,415 | 5/1972 | Wray et al. | 166/321 X |
| 3,782,461 | 1/1974 | Watkins | 166/322 X |
| 3,796,261 | 3/1974 | Nutter | 166/237 |
| 3,814,182 | 6/1974 | Giroux | 166/331 |
| 3,823,773 | 7/1974 | Nutter | 166/321 X |
| 3,842,913 | 10/1974 | Mott | 166/374 |
| 3,850,250 | 11/1974 | Holden et al. | 116/374 |
| 3,856,085 | 12/1974 | Holden et al. | 166/264 |
| 3,858,649 | 1/1975 | Wray et al. | 166/264 X |
| 3,860,069 | 1/1975 | Wray et al. | 166/264 |
| 3,870,104 | 3/1975 | Mott | 166/322 |
| 3,915,228 | 10/1975 | Giebeler | 166/321 |
| 3,930,540 | 1/1976 | Holden et al. | 166/321 X |
| 3,964,305 | 6/1976 | Wray et al. | 166/321 X |
| 3,964,544 | 6/1976 | Farley et al. | 166/264 |
| 3,976,136 | 8/1976 | Farley et al. | 166/321 X |
| 4,047,564 | 9/1977 | Nix et al. | 166/334 X |
| 4,058,165 | 11/1977 | Holden et al. | 166/321 X |
| 4,059,153 | 11/1977 | Nix et al. | 166/264 |
| 4,063,593 | 12/1977 | Jessup | 166/321 X |
| 4,064,937 | 12/1977 | Barrington | 166/321 X |
| 4,076,077 | 2/1978 | Nix et al. | 166/321 X |
| 4,109,724 | 8/1978 | Barrington | 166/321 X |
| 4,109,725 | 8/1978 | Williamson et al. | 166/321 X |
| 4,113,012 | 9/1978 | Evans et al. | 166/321 X |
| 4,144,937 | 3/1979 | Jackson et al. | 166/324 X |
| 4,341,266 | 7/1982 | Craig | 166/317 |

OTHER PUBLICATIONS

"APR Ball Valve Tester", Halliburton Services, Sales and Service Catalog-No. 39, pp. 3310-3311.

*Primary Examiner*—Stephen J. Novosad
*Assistant Examiner*—Thuy M. Bui
*Attorney, Agent, or Firm*—Lucian Wayne Beavers; James R. Duzan; Thomas R. Weaver

[57] ABSTRACT

An annulus pressure responsive downhole tool includes a housing having a power piston slidably disposed therein. First and second pressure conducting passages communicate a well annulus with first and second sides of the power piston. A retarding device is disposed in the second pressure conducting passage for delaying communication of a sufficient portion of an increase in well annulus pressure to the second side of the power piston for a sufficient time to allow a pressure differential across the power piston to move the power piston from a first position to a second position relative to the housing. A pressure relief valve is communicated with the second pressure conducting passage between the power piston and the retarding device for relieving from the second pressure conducting passage a volume of fluid sufficient to permit the power piston to travel to its second position. A back pressure check valve is also disposed in the second pressure conducting passage to provide a continuing but releasable pressure differential across the power piston to releasably hold the power piston in its second position.

15 Claims, 6 Drawing Figures

LOW PRESSURE RESPONSIVE DOWNHOLE TOOL WITH DIFFERENTIAL PRESSURE HOLDING MEANS

BACKGROUND OF THE INVENTION

1. Field of the Invention

The present invention relates to annulus pressure responsive downhole tools. Particularly, the present invention provides an improved design for an annulus pressure responsive downhole tool which eliminates the need for using a large volume of compressible liquid or a volume of compressible gas within the tool to compensate for the volume displaced by a power piston of the tool.

2. Description of the Prior Art

It is well known in the art that downhole tools such as testing valves, circulating valves and samplers can be operated by varying the pressure of fluid in a well annulus and applying that pressure to a differential pressure piston within the tool.

The predominant method of creating the differential pressure across the differential pressure piston has been to isolate a volume of fluid within the tool at a fixed reference pressure. Such a fixed reference pressure has been provided in any number of ways.

One manner of providing a fixed reference pressure is by providing an essentially empty sealed chamber on the low pressure side of the power piston, which chamber is merely fixed with air at the ambient pressure at which the tool was assembled. Such a device is shown for example in U.S. Pat. No. 4,076,077 to Nix et al. with regard to its sealed chamber 42. This type of device does not balance hydrostatic annulus pressure across the power piston as the tool is run into the well.

Another approach has been to provide a chamber on the low pressure side of the piston, and fill that chamber with a charge of inert gas such as nitrogen. Then, when the annulus pressure overcomes the gas pressure, the power piston is moved by that pressure differential, and the gas compresses to allow the movement of the power piston. Such a device is shown for example in U.S. Pat. No. 3,664,415 to Wray et al. with regard to its nitrogen cavity 44. This type of devices does not balance hydrostatic annulus pressure across the power piston as the tool is run into the well.

Another approach has been to use a charge of inert gas as described above, in combination with a supplementing means for supplementing the gas charge pressure with the hydrostatic pressure of the fluid in the annulus contained between the well bore and the test string, as the test string is lowered into the well. Such a device is shown for example in U.S. Pat. No. 3,856,085 to Holden et al. When a tool of this type has been lowered to the desired position in the well, the inert gas pressure is supplemented by the amount of the hydrostatic pressure in the well at that depth. Then, an isolation valve is closed which then traps in the tool a volume of well annulus fluid at a pressure substantially equal to the hydrostatic pressure in the well annulus at that depth. Once the isolation valve has closed, the reference pressure provided by the inert gas is no longer effected by further increases in well annulus pressure. Then well annulus pressure may be increased to create a pressure differential across the power piston to actuate the tool.

Also, rather than utilize a compressible inert gas such as nitrogen within such tools, it has been proposed to use a large volume of a somewhat compressible liquid such as silicone oil on the low pressure side of the piston. Such a device is seen for example in U.S. Pat. No. 4,109,724 to Barrington.

One recent device which has not relied upon either a large volume of compressible liquid or a volume of compressible gas is shown in U.S. Pat. No. 4,341,266 to Craig. This is a trapped reference pressure device which uses a system of floating pistons and a differential pressure valve to accomplish actuation of the tool. The reference pressure is trapped by a valve which shuts upon the initial pressurizing up of the well annulus after the packer is set. The Craig tool does balance hydrostatic pressure across its various differential pressure components as it is run into the well.

Another relatively recent developement is shown in U.S. Pat. No. 4,113,012 to Evans et al. This device utilizes fluid flow restrictors 119 to 121 to create a time delay in any communication of changes in well annulus pressure to the lower side of its power piston. During this time delay the power piston moves from a first to a second position. The particular tool disclosed by Evans et al. utilizes a compressed nitrogen gas chamber in combination with a floating shoe which transmits the pressure from the compressed nitrogen gas to a non-compressible liquid filled chamber. This liquid filled chamber is communicated with a well annulus through pressurizing and depressurizing passages, each of which includes one of the fluid flow restrictors plus a back pressure check valve. Hydrostatic pressure is balanced across the power piston as the tool is run into the well, except for the relatively small differential created by the back pressure check valve in the pressurizing passage.

With most of these prior art devices, there has been the need to provide either a large volume of compressible liquid or a volume of compressible gas to account for the volume change within the tool on the low pressure side of the power piston. This compressible liquid or gas has generally either been silicone oil or nitrogen. There are disadvantages with both of these.

When utilizing a tool which provides a sufficient volume of compressible silicone oil to accommodate the volume change required on the low pressure side of the power piston, the tool generally becomes very large because of the large volume of silicone oil required in view of its relatively low compressibility.

On the other hand, there is a danger in tools that utilize an inert gas, such as nitrogen, as in any high pressure vessel.

Furthermore, most of these prior art tools have required relatively high annulus pressure increases, sometimes as high as 2000 psi, for operation.

SUMMARY OF THE INVENTION

The present invention provides a very much improved annulus pressure responsive tool which operates in response to a relatively low increase in annulus pressure, and which also eliminates the problem of dealing with either a large volume of compressible liquid or a pressurized volume of compressible gas in order to provide for the volume change on the low pressure side of the moving power piston.

The present invention provides an annulus pressure responsive downhole tool apparatus which includes a tool housing having a power piston slidably disposed in the housing,. A first pressure conducting passage communicates the well annulus with a first side of the power piston. A second pressure conducting passage communicates the well annulus with a second side of the power piston. A retarding means, is disposed in the second pressure conducting passage for delaying communication of a sufficient portion of an increase in well annulus pressure to the second side of the power piston for a sufficient time to allow a pressure differential from the first side to the second side of the power piston to move the power piston from a first position to a second position relative to the housing. A pressure relief means is communicated with the second pressure conducting passage, between the second side of the piston and the retarding means, for relieving from the second pressure conducting passage a volume of fluid sufficient to permit the power piston to travel to its second position.

A releasable holding means is provided for releasably preventing the power piston from returning to its first position. This releasable holding means includes a back pressure check valve means, located between the power piston and the retarding means, for preventing communication of a sufficient portion of said increase in well annulus pressure to said second side of said power piston so that so long as said increase in well annulus pressure is maintained on said first side of said power piston, a sufficient pressure differential is maintained from said first side to said second side of said power piston to prevent said power piston from returning to its said first position.

It is the pressure relief means, which relieves fluid from the low pressure side of the power piston, which eliminates the need for using either a compressible gas or a large volume of compressible liquid on the low pressure side of the power piston.

The use of the pressure relief means to accommodate the fluid displaced by the power piston, instead of using a large volume of compressible liquid or a pressurized volume of gas provides a number of advantages.

Since no pressurized nitrogen is used, the dangers associated with the use of pressurized nitrogen are eliminated.

Very significantly, the pressures which must be applied to the well annulus to operate the tools of the present invention are very much reduced as compared to most prior art tools.

Also, the present invention provides a tool which always actuates at the same differential operating pressure. Tools which rely upon compressible liquids or compressible gas do not have constant differential operating pressures because the compressibility of the silicone oil and the nitrogen is non-linear.

The tools of the present invention can be operated with a differential operating pressure of as little as 200–500 psi. This is determined by the strength of the return spring located below the power piston. Thus, if an actual well annulus pressure increase of 1000 psi is used to actuate the tool of the present invention, a wide margin of error is provided assuring that the tool will in fact be actuated.

Prior art tools, particularly those relying upon the compression of silicon oil, require much higher differential operating pressures as high as 2000 psi.

This is particularly important in view of the fact that, assuming the tool in question is a tester valve, the other tools in the test spring, such as circulating valves for example, have to be set to operate at a differential operating pressure greater than that of the tester valve. Typically, it is undesirable to increase the well annulus pressure greater than about 3000 psi because of limits on the strength of the well casing. The present invention, therefore, allows the differential operating pressures of the various tools in the testing string to be spaced further apart, and also generally allows those pressures to be decreased. This improves both the safety and the reliability of operation of the entire testing spring.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
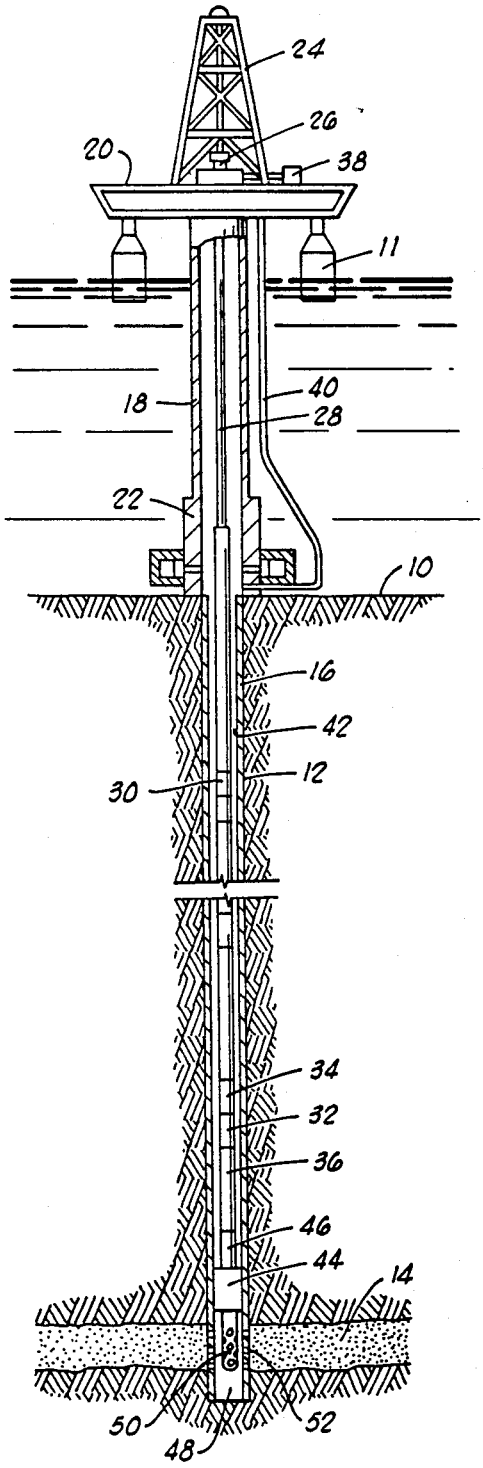
FIG. 1 is a schematic elevation view of an offshore well showing a well test spring in place within the well bore.

Referring now to the drawings, and particularly to FIG. 1, the downhole tool of the present invention is shown in a testing string for use in an offshore oil or gas well.

In FIG. 1, a floating work station 11 is centered over a submerged oil or gas well located in the sea floor 10 having a bore hole 12 which extends from the sea floor 10 to a submerged formation 14 which is to be tested. The bore hole 12 is typically lined by a steel liner or casing 16 which is cemented into place.

A subsea conduit 18 extends from a deck 20 of the floating work station 11 into a well head installation 22. The floating work station 11 has a derrick 24 and hoisting apparatus 26 for raising and lowering tools to drill, test and complete the oil or gas well.

A testing string 28 is shown after it has been lowered into the bore hole 12 of the oil or gas well. The testing string 28 includes such tools as a slip joint 30 to compensate for the wave action of the floating work station 11 as the testing string 28 is being lowered into place, a tester valve 32 and a circulation valve 34. Also, a check valve assembly 36 may be located in the testing spring 28 below the tester valve 32.

The tester valve 32, circulation valve 34, and check valve assembly 36, are operated by fluid annulus pressure exerted by a pump 38 located on the deck 20 of the floating work station 11. Pressure changes are transmitted by a pipe 40 to a well annulus 42 between the casing 16 and the testing string 28.

Annulus pressure in the well annulus 42 is isolated from the formation 14 to be tested by a packer 44 set in the well casing 16 just above the formation 14.

The testing string 28 also generally includes a tubing seal assembly 46 which stabs through the passageway through the production packer 44 forming a seal isolating an upper portion of the well annulus 42 above the packer 44 from an interior bore 48 of the well immediately adjacent the formation 14 and below the packer 44. The interior bore 48 may also be referred to as a lower portion of the well annulus 42 below the packer 44, it being understood that this lower portion 48 of the well annulus 42 is not necessarily annular in shape, but instead includes whatever portion of the well cavity there is below the packer 44.

A perforated tail piece 50, or other production tube, is located at the bottom end of the seal assembly 46 to allow formation fluids to flow from the formation 14 into a flow passage of the testing string 28. Formation fluid is admitted into the lower portion 48 of well annulus 42 through perforations 52 provided in the casing 16 adjacent the formation 14.

A testing string such as that illustrated may be used either to test formation flow from the formation 14, or treat the formation 14 by pumping liquids downward through the test string into the formation 14.

The present invention relates to low pressure responsive tools for use in such a test string.

The specific embodiment illustrated in the drawings and discussed below relates to a tester valve which would be located such as the tester valve 32 in the schematic illustration of FIG. 1.

The scope of the present invention, however, is such that it embodies more than just tester valves, and embodies any downhole tool apparatus which is operated in response to annulus pressure.

Thus the concepts about to be discussed can be utilized for tester valves, circulation valves, such as circulation valve 34 illustrated in FIG. 1, or also for example in sample chambers or the like which might be used with such a test string to trap a sample of the flowing fluid.

DESCRIPTION OF THE PREFERRED EMBODIMENT OF FIGS. 2A-2E

Referring now to FIGS. 2A-2E, an elevation half-section view is thereshown of a tester valve of the present invention, which tester valve is generally designated by the numeral 32. The tester valve 32 may generally be referred to as an annulus pressure responsive downhole tool apparatus 32.

The tester valve 32 includes a tool housing generally designated by the numeral 54. The tool housing 54 includes an upper adaptor 56, a valve housing section 58, a first middle adaptor 60, a power housing section 400, a second middle adaptor 402, a metering cartridge housing section 404, and a lower adaptor 406.

An O-ring seal 70 is provided between upper adaptor 56 and valve housing section 58.

Valve housing section 58 and first middle adaptor 60 are joined at threaded connection 72 and a seal is provided therebetween by O-ring 74.

The upper end of power housing section 400 is threadedly connected to first middle adaptor 60 at threaded connection 408. An O-ring seal 78 is provided therebetween.

Second middle adaptor 402 is threadedly connected to the lower end of power housing section 400 at threaded connection 410 and a seal is provided therebetween by O-ring seal 412.

Metering cartridge housing section 404 is threadedly connected to second middle adaptor 402 at threaded connection 414 and an O-ring seal is provided therebetween by O-ring 416.

Lower adaptor 406 is threadedly connected to metering cartridge housing section 404 at threaded connection 418.

Disposed in the valve housing section 58 is a full opening ball valve means 90.

Figure 2A:
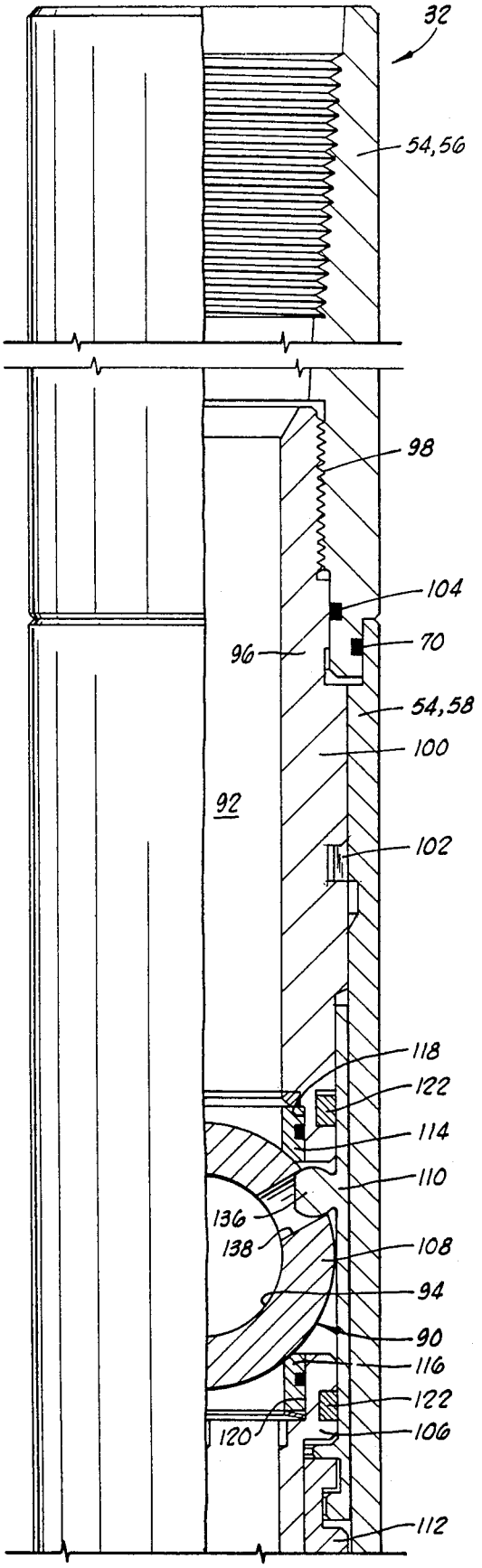
FIGS. 2A–2E comprise an elevation half-section view of the present invention.

The ball valve means 90 is illustrated in FIG. 2A in its first closed position closing a central bore 92 of the tester valve 32. The ball valve means 90 may be rotated 90° relative to the housing 54 to an open position wherein a bore 94 of ball valve means 90 is aligned with central bore 92.

The ball valve means 90 includes an upper valve support 96 which is threadedly connected to upper adaptor 56 at threaded connection 98. Radially outwardly extending splines 100 of upper valve support 96 are engaged with radially inwardly extending splines 102 of valve section housing 58 to prevent relative rotation between those members. An O-ring seal 104 is provided between upper adaptor 56 and upper valve support 96.

Ball valve means 90 also includes a lower valve support 106, a ball 108, ball valve actuating arms 110 (only one of which is shown) and an actuating sleeve 112.

Upper and lower valve seats 114 and 116 are received within counterbores 118 and 120, respectively, of upper and lower valve supports 96 and 106. C-clamps 122 bias the upper and lower valve supports 96 and 106 toward each other so that the seats 114 and 116 are held in close engagement with the ball 108.

Figure 2B:
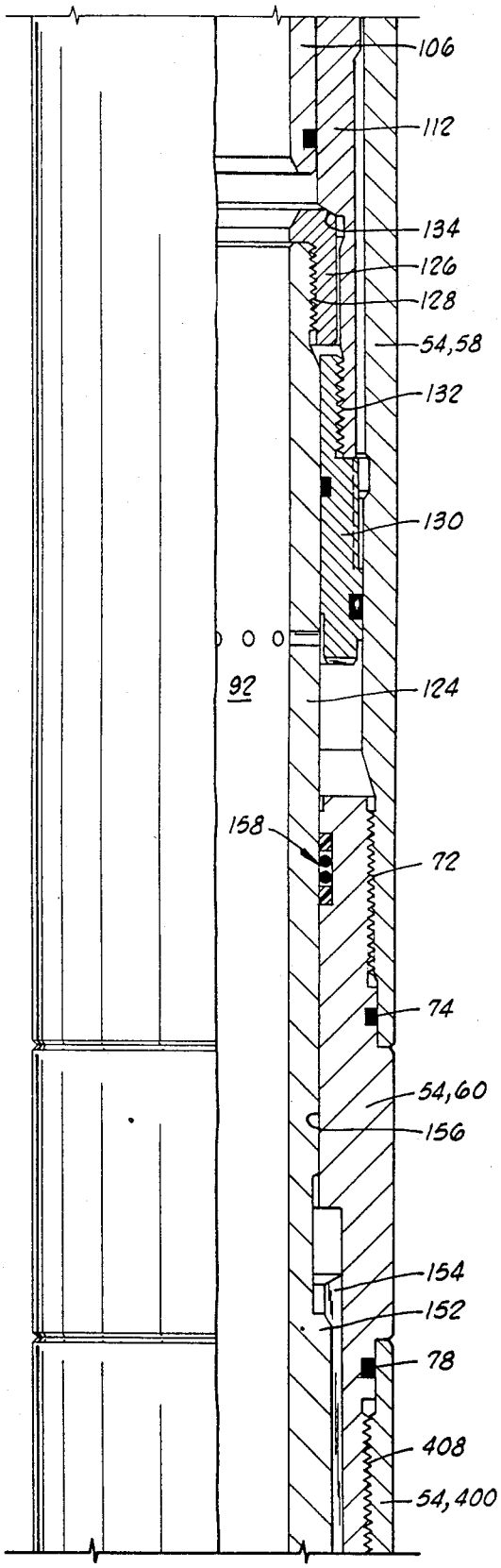

Referring now to FIG. 2B, a ball valve actuating mandrel 124 has its upper end received within actuating sleeve 112. An upper end collar 126 is threadedly connected to ball valve actuating mandrel 124 at threaded connection 128. A lower end collar 130 is threadedly connected to the lower end of actuating sleeve 112 at threaded connection 132 so that upper end collar 126 is trapped between lower end collar 130 and a downward facing shoulder 134 of actuating sleeve 112.

Thus, when ball valve actuating mandrel 124 is moved downward from the position illustrated in FIG. 2B, it pulls actuating sleeve 112 and ball valve actuating arms 110 downward relative to housing 54 so that a lug 136 of each ball valve actuating arm 110 which is received within a eccentric hole 138 of ball 108 causes the ball 108 to be rotated through an angle of 90° so that its bore 94 is aligned with the central bore 92 of the tester valve 32.

Figure 2C:
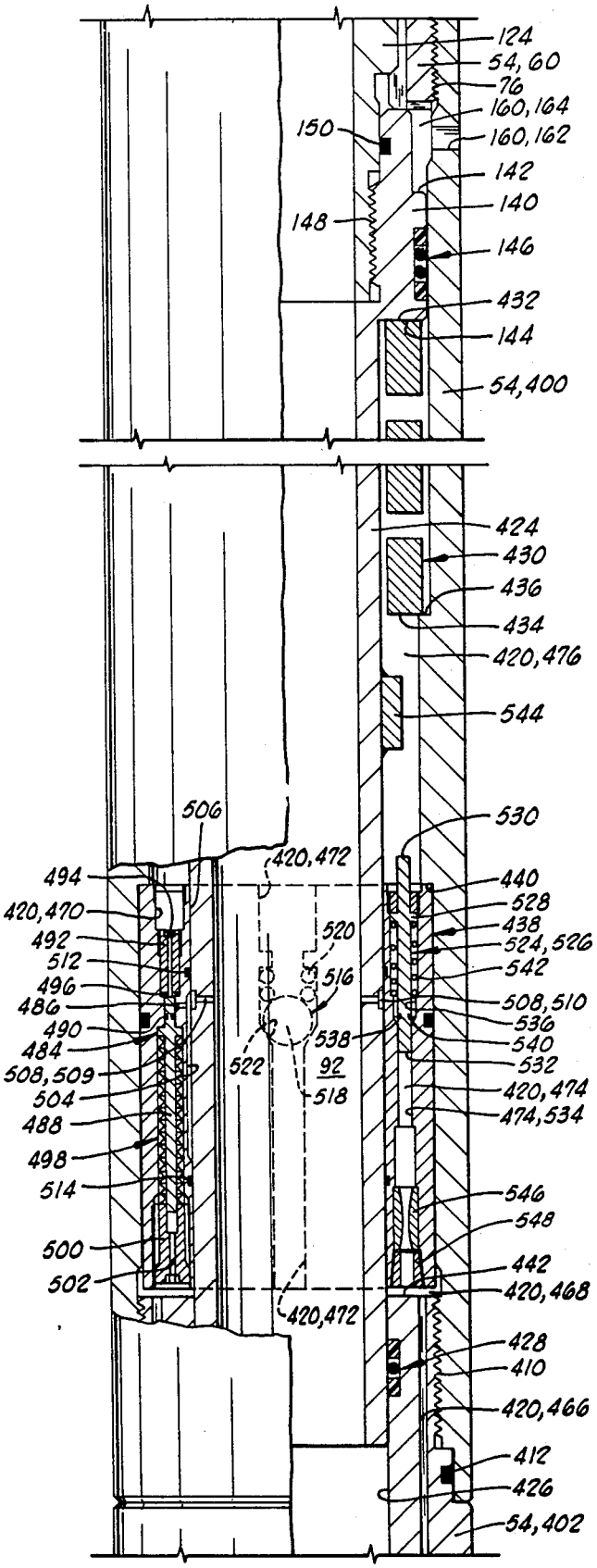

Referring now to FIG. 2C, a power piston 140 is slidably disposed in power housing section 400. Power piston 140 has a first side 142 and a second side 144. A double O-ring sliding seal means 146 is provided between power piston 140 and power housing section 400.

The ball valve actuating mandrel 124 is threadedly connected to power piston 140 at threaded connection 148 and O-ring seal 150 is provided therebetween.

Ball valve actuating mandrel 124 includes a plurality of radially outward extending splines 152 which engage radially inwardly extending splines 154 of first middle adaptor 60 to prevent relative rotation therebetween.

An intermediate portion of ball valve actuating mandrel 124, seen in FIG. 2B, is closely received within a bore 156 of first middle adaptor 60 and a double O-ring sliding seal means 158 is provided therebetween.

Disposed in the tester valve apparatus 32 is a first pressure conducting passage means 160 for communicating the well annulus 42 (see FIG. 1) with first side 142 of power piston 140. First pressure conducting passage means 160 includes a power port 162, and thus may be referred to as power passage means 160. First pressure conducting passage means 160 also includes an annular cavity 164 defined between power housing section 400 and the combined power piston 140 and ball valve actuating mandrel 124.

A second pressure conducting passage means 420 communicates a balancing port 422 (see FIG. 2E) with second side 144 of power piston 140.

Extending downward from power piston 140 is a guide mandrel means 424 which has its lower end closely and slidably received within an upper counterbore 426 of first middle adaptor 402. A sliding seal is provided therebetween by O-ring 428.

A resilient biasing means 430, is operatively associated with power piston 140, for biasing the power piston 140 upward towards its first position illustrated in FIG. 2C. The resilient biasing means 430 in the embodiment illustrated is a coil compression spring 430 having an upper end 432 engaging the second side 144 of power piston 140 and having its lower end 434 engaging an upward facing radially inward extending shoulder 436 of power housing section 400.

A pressure relief cartridge 438 is concentrically disposed outside of guide mandrel 424 and inside of power housing section 400, and is held longitudinally in place relative to power housing section 400 between a downward facing radially inward extending annular shoulder 440 of power housing section 400 and an upper end 442 of second middle adaptor 402.

Figure 2D:
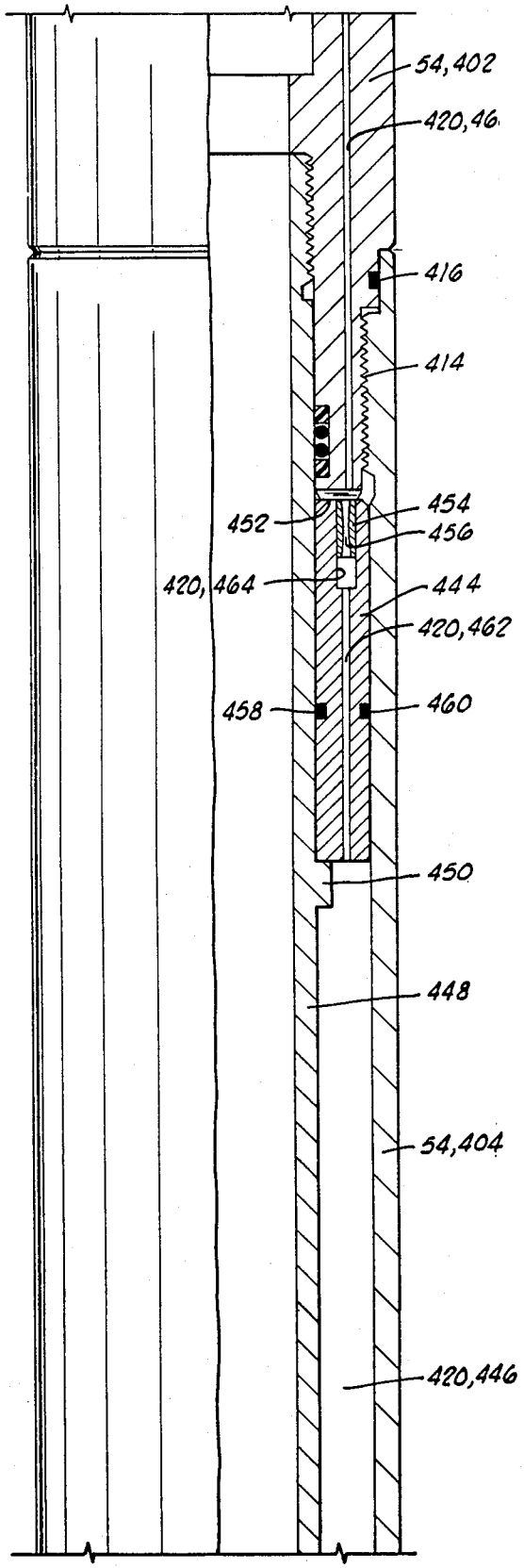
Figure 2E:
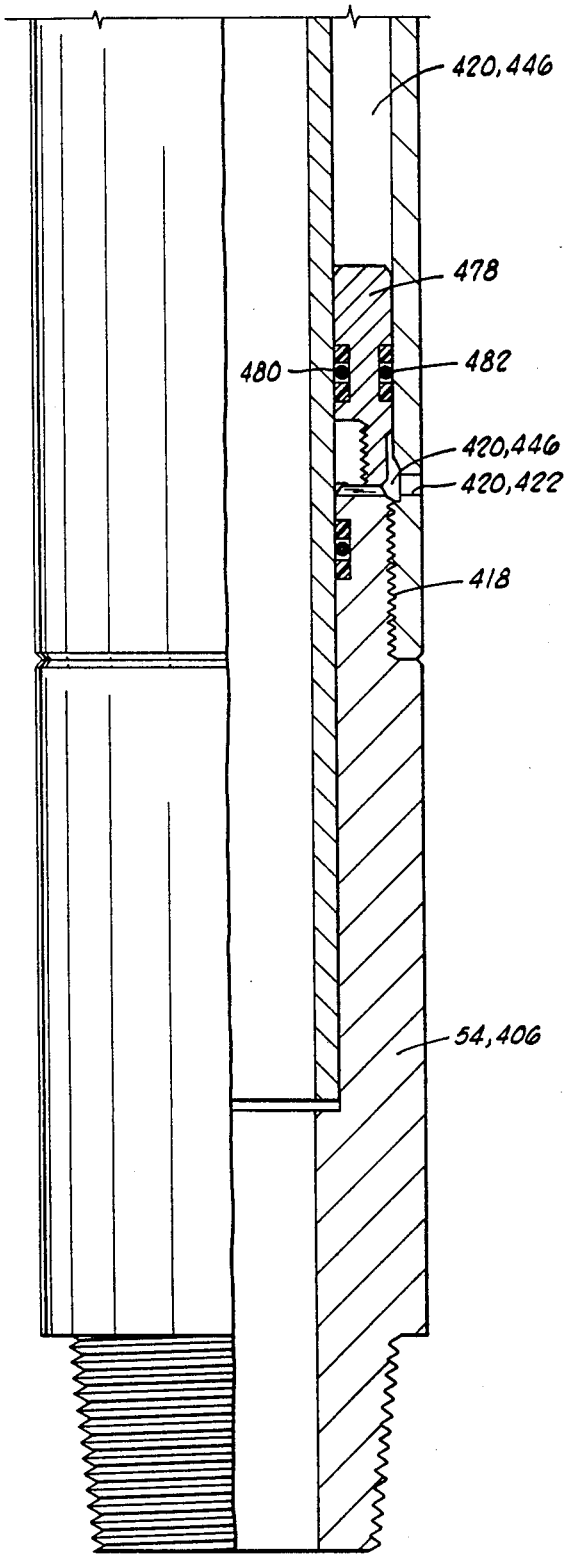

Referring now to FIG. 2D, a metering cartridge retarding means 444 is located in an annular cavity 446 defined between a lower inner mandrel 448 and metering cartridge housing section 404. Metering cartridge 444 is held longitudinally in place between a radially outward extending ledge 450 of lower inner mandrel 448 and a lower end 452 of second middle adaptor 402.

A flow restrictor 454 is located in metering cartridge 444 and includes a reduced diameter flow passage 456 shown in cross section therein. Inner and outer O-ring seals 458 and 460 seal between metering cartridge 444 and lower inner mandrel 448 and metering cartridge housing section 404, respectively. The metering cartridge 444 may generally be described as a retarding means 444 disposed in the second pressure conducting passage means 420 for delaying communication of a sufficient portion of an increase in the well annulus fluid pressure to the second side 144 of power piston 140 for a sufficient time to allow a pressure differential from the first side 142 to the second side 144 of power piston 1400 to move power piston 140 from a first position to a second position relative to the housing 54.

The second pressure conducting passage means 420 of the tester valve 32 includes, beginning at the lower end, balancing port 422, annular cavity 446, a longitudinal bore 462 and a counterbore 464 of metering cartridge 444, a longitudinal bore 466 of second middle adaptor 402, a short annular cavity 468 defined between guide mandrel means 424 and power housing section 400, first, second and third cartridge passages 470, 472 and 474 disposed through the length of pressure relief cartridge 438, and an annular cavity 476 defined between guide mandrel means 424 and power housing section 400.

An annular floating shoe 478 is disposed within annular cavity 446 above balancing port 422 and has annular inner and outer sliding seals 480 and 482.

A pressure relief means 484 is disposed in first cartridge passage 470 for relieving from a first portion of the second pressure conducting passage means 420 a volume of fluid sufficient to permit power piston 140 to travel to its second position. This first portion of the second pressure conducting passage means 420 is that portion between the second side 144 of power piston 140 and the retarding means 444. The second pressure conducting passage means 420 is filled with a hydraulic fluid such as silicone oil throughout its length between the second side 144 of power piston 140 and the annular floating shoe 478.

This silicone oil is sufficiently incompressible such that the volume thereof located between the power piston 140 and the pressure relief means 484 would hydraulically block the power piston 140 from traveling to its second position unless a volume of this fluid equal to the displacememt of power piston 140 were relieved from the first portion of the second pressure conducting passage means 420 by the pressure relief means 484.

The pressure relief cartridge 438 may also be referred to as a relief housing 438. A relief port 486 is disposed through the relief housing 438 and communicates the first portion of the second pressure conducting passage means 420 with the fluid dump zone 92 which is also the central bore of the tester valve 32.

A pressure relief piston means 488 is slidably disposed in first cartridge passageway 470 and is movable between a first position illustrated in FIG. 2C wherein relief port 486 is closed, and a second position wherein the pressure relief piston 488 is displaced downward relative to relief housing 438 from the position illustrated in FIG. 2C, so that the relief port 486 is opened.

When pressure relief piston means 488 is in its closed position as illustrated in FIG. 2C, an O-ring seal 490 disposed in the outer surface of an upper end portion of pressure relief piston means 488 seals within the first cartridge passageway 470 below relief port 486.

Disposed within first cartridge passageway 470 above pressure relief piston means 488 is a threaded insert 492 having a longitudinal bore 494 extending therethrough. The lowermost end portion of insert 492 is reduced in diameter and has an O-ring seal 496 disposed thereabout.

An uppermost extremity of pressure relief piston 488 has a knife edge defined thereon which engages O-ring seal 496 to provide a seal above the relief port 486.

A resilient relief piston biasing means 498, comprised of a stack of Belleville springs, is disposed about a lower cylindrical portion of pressure relief piston means 488 and serves to bias pressure relief piston means 488 towards its closed position.

A lower threaded insert 500 engages the lower end of the stack of Belleville springs 498 and may be threadedly adjusted to adjust the compression of the stack of springs 498. A longitudinal bore 502 is disposed through lower threaded insert 500.

The relief port 486 communicates with a longitudinal groove 504 disposed in an inner cylindrical surface 506 of pressure relief cartridge 438.

The guide mandrel means 424 has a dump passage 508 disposed therethrough and communicated with the fluid dump zone 92. Dump passage 508 includes a plurality of radial ports 509 and an outer annular groove 510 disposed in guide mandrel means 424 and communicated with the ports 509.

The longitudinal groove 504 of pressure relief cartridge 438 is communicated with annular groove 510 of dump passaage 508 throughout the travel of power piston 140 and its attached guide mandrel means 424.

Upper and lower O-ring seals 512 and 514 seal between pressure relief cartridge 438 and guide mandrel 424 above and below the longitudinal groove 504.

A back pressure check valve means 516 is disposed in second cartridge passage 472 for preventing communication of a sufficient portion of an increase in well annulus pressure to the second side 144 of power piston 140 so that as long as said increase in well annulus pressure is maintained on said first side 142 of power piston 140, a sufficient pressure differential is maintained from said first side 142 to the second side 144 of power piston 140 to prevent the resilient biasing means 430 from returning the power piston 140 to its first position.

This back pressure check valve means 516, which is only schematically illustrated in FIG. 2C, includes a ball 518 which is resiliently biased by a coil compression spring 520 downward against a valve seat 522.

The back pressure check valve means 516 is designed such that it prevents a substantial portion of any increase in the well annulus pressure from ever reaching the second side 144 of power piston 140, so that when an increase in well annulus pressure is applied to the well annulus, there is always a downward pressure differential across power piston 140 so long as that increase in well annulus pressure is maintained on the well annulus. This downward pressure differential which iss maintained on the power piston 140 is sufficiently great that it always is greater than the upward biasing force of biasing means 430 whereby the power piston 140 may be said to be releasably held in its second position so long as the increase in well annulus pressure is maintained on the well annulus.

For example, if the upward biasing force of spring 430 is equivalent to an upward pressure differential of 400 psi across the power piston 140, then the back pressure check valve means 516 would be designed to open at a 600 psi pressure differential so that the fluid pressure in annular cavity 476 is always at least 600 psi less than the annulus fluid pressure so long as an increase in annulus fluid pressure of greater than 600 psi which was applied to the annulus is maintained on the annulus fluid.

Thus, the back pressure check valve means may be said to be a releasable holding means 516 releasably preventing the power piston 140 from returning to its first position.

A run-in balance means 524 is disposed in third cartridge passage 474 for allowing well annulus pressure to sufficiently balance across power piston 140 as the tester valve 32 is run into the well so that a pressure differential from the first side 142 to the second side 144 of power piston 140 is never sufficient to overcome the resilient biasing means 430 and prematurely move the power piston 140 to its second position as the tester valve 32 is run into the well.

The run-in balance means 524 includes a balance valve means 526 movable relative to pressure relief cartridge 438 between an open position illustrated in FIG. 2C, wherein fluid may flow through third cartridge passage 474, and a closed position, displaced downwardly slightly relative to pressure relief cartridge 438 from the position illustrated in FIG. 2C, to a closed position wherein fluid flow through the third cartridge passage 474 is prevented.

Balance valve means 526 is substantially cylindrical in shape and has a radially outward extending ledge 528 defined on an intermediate part thereof.

A first end 530 of balance valve means 526 extends upward out of third cartridge passage 474 toward the power piston 140.

A second end 532 of balance valve means 526 is closely received within a reduced inner diameter portion 534 of third cartridge passage 474.

Third cartridge passage 474 includes an enlarged inner diameter portion 536 located above reduced inner diameter portion 534, and the inner surfaces 534 and 536 are joined by a tapered seating surface 538.

When balance valve means 526 is in its open position as illustrated in FIG. 2C, an O-ring seal 540 disposed about a lower portion of balance valve means 528 is located above tapered seating surface 538 out of engagement therewith, so that fluid may flow through the relatively small clearances between balance valve means 526 and the reduced diameter portion 534 of third cartridge passage 474.

Disposed about balance valve means 526 below the ledge 528 thereof is a coil compression balance valve biasing spring 542 which biases balance valve means 526 upward toward its open position.

An actuating lug 544 is attached to the guide mandrel 424, which may also be referred to in the present embodiment as an operating mandrel 424, for engaging the first end 530 of balance valve means 526 and for moving the balance valve means 526 to its closed position wherein the O-ring seal 540 sealingly engages the tapered seating surface 538 as the power piston 140 moves to its second position.

Actuating lug 544 provides an actuating means, operatively associated with power piston 140, for mechanically moving the balance valve means 526 to its closed position as the power piston 140 moves to its second position.

In the lower end of third cartridge passage 474, a fluid restrictor 546 is held in place by a lower threaded insert 548. Fluid restrictor 546 protects balance valve means 526 from excessive pressure differentials which might damage it.

The third cartridge passage 474 may also generally be referred to as a bypass portion 474 of the second pressure conducting passage means 420, which bypass portion bypasses the pressure relief means 484.

As is further explained below in the description of the operation of the tester valve 32, the balance valve means 526 may also be referred to as a seal valve means 526, disposed in the second pressure conducting passage means 420, for preventing communication of any further portion of the increase in well annulus pressure to the second side 144 of power piston 140 after the back pressure check valve means 516 has finally closed subsequent to the power piston 140 reaching its second position. Thus, the actuating lug 544 may also be referred to as an actuating means 544, operatively associated with the power piston 140, for mechanically closing the seal valve means 526 when the power piston 140 moves to its second position.

Further, the retarding means 444 may also be further characterized as being a means for allowing a first additional portion of the increase in well annulus pressure to be communicated to the second side 144 of the power piston 140 after the power piston 140 is moved to its second position.

OPERATION OF THE PREFERRED EMBODIMENT

The operation of the tester valve 32 of FIGS. 2A–2E is generally as follows.

The tester valve 32 is initially oriented as illustrated in FIGS. 2A–2E and is made up with the test string 28 in the position designated by the numeral 32 in FIG. 1.

The tester valve 32 is then run down into the well defined by well casing 16 with the ball valve means 90 in its closed position closing the central bore flow passage 92 of the tester valve 32, and with the power piston 140 in its first position as illustrated in FIG. 2C.

The coil compression spring 430 resiliently biases the power piston 140 towards its first position.

As the tester valve 32 is run into the well, the increase in hydrostatic pressure of the well annulus fluid with increasing depth is sufficiently balanced across the power piston 140 so that a pressure differential from the first side 142 to the second side 144 of power piston 140 is never sufficient to overcome the resilient biasing means 430 and prematurely move the power piston 140 to its second position as the tester valve 32B is being run into the well.

This balancing of well annulus hydrostatic pressure as the tester valve 32 is run into the well is accomplished by the balance valve means 526.

The increase in hydrostatic well annulus pressure is communicated, with a time delay due to the retarding means 444, to the lower end of third cartridge passage 474, and then through the slight clearance between the lower end of balance valve means 526 and the reduced diameter internal bore portion 534 of third cartridge passage 474 upward to annular cavity 476 and the second side 144 of power piston 140. Sufficient fluid flow can be obtained through these small clearances because the only fluid flow which is required in order to balance the increasing hydrostatic pressure across the power piston 140, is the very slight flow necessary to account for the slight compressibility of the silicone oil which is trapped between the second side 144 of power piston 140 and the pressure balance cartridge 438.

Once the tester valve 32 is in the position illustrated in FIG. 1, the packer means 44 is set to separate the well annulus 42 into an upper portion above the packer means 44 and the lower portion 48 below the packer means 44. The power port 162 and balancing port 422, and accordingly the first and second pressure conducting passage means 160 and 420, respectively, are communicated with the upper portion of the well annulus 42 above the packer means 44. The flow passage central bore 92 of the tester valve 32 is communicated with the lower portion 48 of the well annulus 42 below the packer means 44.

After setting the packer means, an increase in annulus fluid pressure is applied to the annulus fluid in the upper portion of the well annulus 42 above the packer means 44.

This increase in annulus pressure is substantially instantaneously communicated to the first side 142 of power piston 140 through the first pressure conducting passage means 160.

The fluid flow restrictor 454 of retarding means 444 delays communication of a sufficient portion of this increase in annulus fluid pressure to the second side 144 of power piston 140 for a sufficient time to allow a pressure differential from first side 142 to second side 144 of power piston 140 to move the power piston 140 downward to its second position corresponding to an open position of ball valve means 90.

Initially, the power piston 140 is hydraulically blocked from moving downward by the fluid trapped between the power piston 140 and the pressure relief cartridge 438.

The downward pressure differential across pressure relief piston means 488, however, quickly causes pressure relief piston 488 to move downward breaking the seal with O-ring 496 so as to open the pressure relief means 484 and allow fluid trapped below the power piston 140 to be relieved through the relief port 486 and the dump passage 508 into the dump zone 92. This fluid is continuously relieved to the dump zone 92 as the power piston 140 moves from its first position to its second position. The volume of fluid relieved through the pressure relief means 484 is equal to a volume of fluid displaced by the power piston 140 as it travels from its first position to its second position.

As the power piston 140 moves from its first position to its second position it rotates the ball valve means 90 to an open position wherein the bore 94 thereof is vertically aligned with the central bore 92 of tester valve 32.

In the last thirty to forty thousandths of an inch of movement of the power piston 140, the actuating lug 544 engages the upper end 530 of balance valve and seal valve means 526 to thereby mechanically close the balance valve and seal valve means 526 as the power piston 140 moves to its second position.

This closing of the balance valve and seal valve means 526 prevents communication of any further portion of the increase in well annulus pressure to the second side 144 of power piston 140 after the back pressure check valve means 516 has finally closed subsequent to the power piston 140 reaching its second position.

With regard to the movement of the back pressure check valve means 516, it of course is in a closed position while the power piston 140 is moving downward from its first position to its second position, because there is a downward pressure differential across the ball valve means 516.

The downward movement of the power piston 140 occurs very rapidly, in a matter of just a few seconds or less, and thus after the power piston 140 reaches its lowermost position wherein the actuating lug 544 mechanically holds the balance valve and seal valve means 526 closed, there is still a substantial amount of the increase in well annulus pressure which has not yet been communicated through the retarding means 444. Thus, as the increase in annulus fluid pressure continues to be communicated to the lower side of pressure relief cartridge 438 through the retarding means 444, the pressure in second pressure conducting passage means 420 below pressure relief cartridge 438 will ultimately exceed the pressure in annular cavity 476 above pressure relief cartridge 438.

When the pressure below pressure relief cartridge 438 exceeds the pressure above pressure relief cartridge 438 by a value greater than the opening value of the back pressure check valve means 516, the back pressure check valve means 516 will open so as to control the pressure in the annular cavity 476 above the pressure relief cartridge 438.

Thus, ultimately several minutes after the increase in annulus pressure has been applied to the well annulus 42, and so long as the increase in annulus pressure is maintained on the well annulus, a situation will be reached wherein the pressure relief valve means 484 has returned to its closed position as illustrated in FIG. 2C, the balance valve and seal valve means 526 is mechanically held in a closed position by actuating lug 544 engaging the upper end 530 thereof, and the back pressure check valve means 516 is finally closed, trapping a pressure in the annular cavity 476 which is equal to the well annulus pressure minus the operating pressure of the back pressure check valve means 516.

Thus, at this equilibrium state, a downward pressure differential is maintained across power piston 140 which is equal to the operating pressure of the back pressure check valve means 561. This operating pressure is designed such that the downward pressure differential across power piston 140 will always be greater than the upward force being exerted by resilient biasing means 430, so long as the increase in annulus pressure is maintained on the well annulus.

Then, in order to reclose the ball valve means 90, the increase in well annulus pressure is rapidly dropped, thus allowing the resilient biasing means 430 to move the power piston 140 upward and return it to its first position.

Upon this upward movement of power piston 140, most of the oil flow, which is necessary from the second pressure conducting passage means 420 below pressure relief cartridge 438 upward through pressure relief cartridge 438 to the annular cavity 476 to replace the fluid which was lost during the downward movement of the power piston 140, flows upward through the second cartridge passage 472 past the back pressure check valve means 516.

Also, the initial thirty to forty thousandths inch movement upwardly of power piston 140 allows the seal of O-ring 540 with tapered seating surface 538 to be broken. This seal is broken due to the resilient balance valve compression spring 544 biasing the balance valve 526 upward. The compressibility of the silicone oil located in second pressure conducting passage means 420 below the balance valve means 526 allows this initial thirty to forty thousandths inch movement even if there has not yet been any upward fluid flow through the second cartridge passage 472.

Once the upward pressure differential across pressure relief cartridge 438 decreases to below the operating pressure of back pressure check valve means 516, the back pressure check valve means 516 will close and the remaining upward oil flow necessary to allow the power piston 140 to return all the way upward to its first position is provided by flow through the third cartridge passage 474 pass the balance valve means 526 in the manner previously described.

The number of times which the tester valve 32 can be cycled between the open and closed positions of ball valve means 90 is dependent upon the volume of fluid within annular cavity 446 which can be displaced as the floating shoe 478 moves upward in the annular cavity 446. When the upper end of floating shoe 478 engages the ledge 450, the tester valve 32 must be removed from the well and the annular cavity 446 must be refilled with fluid above floating shoe 478.

Thus, it is seen that the methods and apparatus of the present invention readily achieve the ends and advantages mentioned as well as those inherent therein. While certain preferred embodiments of the present invention have been illustrated for the purposes of the present disclosure, numerous changes in the arrangement and construction of parts may be made by those skilled in the art which changes are encompassed within the scope and spirit of the present invention as defined by the appended claims.

What is claimed is:

1. An annulus pressure responsive downhole tool apparatus, comprising:

a tool housing;

a power piston slidably disposed in said housing;

a first pressure conducting passage means for communicating a well annulus with a first side of said power piston;

a second pressure conducting passage means for communicating said well annulus with a second side of said power piston;

retarding means, disposed in said second pressure conducting passage means, for delaying communication of a sufficient portion of an increase in well annulus pressure to said second side of said power piston for a sufficient time to allow a pressure differential from said first side to said second side of said power piston to move said power piston from a first position to a second position relative to said housing;

pressure relief means, communicated with a first portion of said second pressure conducting passage means between said second side of said power piston and said retarding means, for relieving from said first portion of said second pressure conducting passage means a volume of fluid sufficient to permit said power piston to travel to its said second position; and releasable holding means, for releasably preventing said power piston from returning to its first position, said releasable holding means including back pressure check valve means, located between said power piston and said retarding means, for preventing communication of a sufficient portion of said increase in well annulus pressure to said second side of said power piston so that so long as said increase in well annulus pressure is maintained on said first side of said power piston a sufficient pressure differential is maintained from said first side to said second side of said power piston to prevent said power piston from returning to its said first position.

2. The apparatus of claim 1, further comprising:

resilient biasing means, operatively associated with said power piston, for biasing said power piston toward its said first position; and wherein said back pressure check valve means is a means for preventing said resilient biasing means from returning said power piston to its said first position so long as said increase in well annulus pressure is maintained on said first side of said power piston.

3. The apparaus of claim 2, wherein:

said resilient biasing means includes a coil compression spring.

4. The apparatus of claim 2, further comprising:

seal valve means, disposed in said second pressure conducting passage means, for preventing communication of any further portion of said increase in well annulus pressure to said second side of said power piston after said back pressure check valve means has finally closed subsequent to said power piston reaching its said second position.

5. The apparatus of claim 4, further comprising:

actuating means, operatively associated with said power piston, for mechanically closing said seal valve means as said power piston moves to its said second position.

6. The apparatus of claim 2, wherein:

said retarding means is further characterized as also being a means for allowing a first additional portion of said increase in well annulus pressure to be communicated to said second side of said power piston after said power piston is moved to its said second position.

7. The apparatus of claim 6, further comprising:

seal valve means, disposed in said second pressure conducting passage means, for preventing communication of any further portion of said increase in well annulus pressure to said second side of said power piston after said back pressure check valve means has finally closed subsequent to said power piston reaching its said second position.

8. The apparatus of claim 1, further comprising:

run-in balance means for allowing well annulus pressure to sufficiently balance across said power piston as said apparatus is run into said well so that a pressure differential from said first side to said second side of said power piston is never sufficient to prematurely move said power piston to its said second position when said apparatus is being run into said well.

9. The apparatus of claim 8, wherein:

said second pressure conducting passage means includes a bypass portion bypassing said pressure relief means; and said run-in balance means includes:

balance valve means, disposed in said bypass portion, said balance valve means being movable between an open position, wherein fluid may flow in either direction through said bypass portion, and a closed position wherein fluid flow through said bypass portion is prevented;

resilient balance valve biasing means for biasing said balance valve means toward its open position; and actuating means, operatively associated with said power piston, for mechanically moving said balance valve means to its closed position as said power piston moves to its second position.

10. An annulus pressure responsive downhole tool apparatus, comprising:

a tool housing;

a power piston slidably disposed in said housing;

a first pressure conducting passage means for communicating a well annulus with a first side of said power piston;

a second pressure conducting passage means for communicating said well annulus with a second side of said power piston;

retarding means, disposed in said second pressure conducting passage means, for delaying communication of a sufficient portion of an increase in well annulus pressure to said second side of said power piston for a sufficient time to allow a pressure differential from said first side to said second side of said power piston to move said power piston from a first position to a second position relative to said housing;

resilient biasing means, operatively associated with said power piston, for biasing said power piston toward its said first position;

a cylindrical operating mandrel extending longitudinally from said second side of said power piston;

an annular pressure relief cartridge disposed within and fixed relative to said housing, said cartridge being located within said second pressure conducting passage means and between said second side of said power piston and said retarding means, said cartridge having first, second and third cartridge passages disposed therethrough and defining a part of said second pressure conducting passage means, said cartridge having a central bore in which said operating mandrel is slidably received;

pressure relief means, disposed in said first cartridge passage, for relieving from said second pressure conducting passage means a volume of fluid sufficient to permit said power piston to travel to its said second position;

back pressure check valve means, disposed in said second cartridge passage, for preventing communication of a sufficient portion of said increase in well annulus pressure to said second side of said power piston so that so long as said increase in well annulus pressure is maintained on said first of said power piston a sufficient pressure differential is maintained from said first side to said second side of said power piston to prevent said resilient biasing means from returning said power piston to its said first position;

balance valve means, disposed in said third cartridge passage, said balance valve means being movable relative to said cartridge between an open position wherein fluid may flow through said third cartridge passage, and a closed position wherein fluid flow through said third cartridge passage is prevented, said balance valve means having a first end extending out of said third cartridge passage toward said power piston; and an actuating lug, attached to said operating mandrel, for engaging said first end of said balance valve means and for moving said balance valve means to its closed position as said power piston moves to its said second position.

11. A method of operating an annulus pressure responsive downhole tool of the type including a power piston slidably disposed in a housing and first and second pressure conducting passages communicating a well annulus with first and second sides of said power piston, said method comprising the steps of:

applying an increase in annulus fluid pressure to an annulus fluid in said well annulus;

communicating said increase in annulus fluid pressure to said first side of said power piston through said first pressure conducting passage;

delaying communication of a sufficient portion of said increase in annulus fluid pressure to said second side of said power piston a sufficient time to allow a pressure differential from said first side to said second side of said power piston to move said power piston from a first position thereof to a second position thereof relative to said housing;

relieving from said second pressure conducting passage a volume of fluid sufficient to permit said power piston to travel to its said second position; and releasably preventing said power piston from returning to its first position by preventing communication of a sufficient portion of said increase in annulus fluid pressure to said second side of said power piston so that so long as said increase in annulus fluid pressure is maintained on said first side of said power piston a sufficient pressure differential is maintained from said first side to said second side of said power piston to prevent said power piston from returning to its said first position.

12. The method of claim 11, further comprising the step of:

resiliently biasing said power piston toward its said first position.

13. The method of claim 12, further comprising the steps of:

running said tool into said well; and sufficiently balancing, by means of a pressure balance valve disposed in said second pressure conducting passage, well annulus pressure across said power piston as said tool is run into said well so that a pressure differential from said first side to said second side of said power piston is never sufficient to overcome said resilient biasing and prematurely move said power piston to its second position as said tool is being run into said well.

14. The method of claim 13, further comprising the step of:

mechanically closing said pressure balance valve as said power piston moves to its said second position.

15. The method of claim 11, further comprising the step of:

allowing a first additional portion of said increase in annulus fluid pressure to be communicated to said second side of said power piston after said power piston is moved to its said second position.

* * * * *

UNITED STATES PATENT AND TRADEMARK OFFICE

CERTIFICATE OF CORRECTION

PATENT NO. : 4,489,786

DATED : Dec. 25, 1984

INVENTOR(S) : Harold K. Beck

It is certified that error appears in the above-identified patent and that said Letters Patent is hereby corrected as shown below:

In column 4, line 15, delete the word [spring] and insert therefor --string--.
In column 4, line 43, delete the word [spring] and insert therefor --string--.
In column 9, line 17, delete the word [iss] and insert therefor -is--.
In column 12, line 67, delete the numeral [561] and insert therefor --516--.

Signed and Sealed this

*Twenty-fifth* Day of *June 1985*

[SEAL]

*Attest:*

DONALD J. QUIGG

*Attesting Officer* *Acting Commissioner of Patents and Trademarks*